US010995517B2

(12) United States Patent
Crandall et al.

(10) Patent No.: US 10,995,517 B2
(45) **Date of Patent: *May 4, 2021**

(54) FENCE BRACE SYSTEM

(71) Applicants: Fonda Crandall, Reno, NV (US); Joseph Crandall, Reno, NV (US)

(72) Inventors: Fonda Crandall, Reno, NV (US); Joseph Crandall, Reno, NV (US)

( * ) Notice: Subject to any disclaimer, the term of this patent is extended or adjusted under 35 U.S.C. 154(b) by 7 days.

This patent is subject to a terminal disclaimer.

(21) Appl. No.: 16/694,162

(22) Filed: Nov. 25, 2019

(65) Prior Publication Data

US 2020/0095797 A1 Mar. 26, 2020

Related U.S. Application Data

(63) Continuation-in-part of application No. 16/004,248, filed on Jun. 8, 2018, now Pat. No. 10,513,869, and a continuation of application No. 16/517,581, filed on Jul. 20, 2019, now Pat. No. 10,597,899, said application No. 16/004,248 is a continuation-in-part of application No. 14/863,793, filed on Sep. 24, 2015, now Pat. No. 10,030,408.

(51) Int. Cl.
*E04H 17/14* (2006.01)

(52) U.S. Cl.
CPC ..... *E04H 17/1417* (2013.01); *E04H 17/143* (2013.01); *E04H 17/1447* (2021.01); *E04H 17/1452* (2021.01); *E04H 17/1473* (2021.01)

(58) Field of Classification Search
CPC ..... E04H 17/1413; E04H 17/1417; E04H 17/1426; E04H 17/143; E04H 17/1439; E04H 17/1447; E04H 17/1452; E04H 17/1473
See application file for complete search history.

(56) References Cited

U.S. PATENT DOCUMENTS 949,394 A * 2/1910 Daly ..... E04B 1/2403
3,256,030 A * 6/1966 Banse ..... E04B 1/2608 403/400
4,526,348 A * 7/1985 Cammack ..... F16B 7/0486 256/65.06
5,190,268 A * 3/1993 Espinueva ..... F16B 9/052 256/67
5,657,967 A * 8/1997 Patrick ..... B29B 17/0042 256/19

(Continued)

FOREIGN PATENT DOCUMENTS

GB 275371 * 8/1927 ..... E04H 17/1413
GB 677092 * 8/1952 ..... E04H 17/1413

*Primary Examiner* — Michael P Ferguson

(57) ABSTRACT

The present invention comprises a brace adapted to secure a fence rail to a fence post. The present invention brace may optionally be installed onto an existing fence or on a new fence. The invention includes a first fence rail brace member adapted to connect to two or more sides of a first fence rail, a second fence rail brace member adapted to connect to two or more sides of a second fence rail, and a fence post member adapted to connect to two or more sides of a fence post. The fence post brace member may form a vertical picket fastener slot, the first fence rail brace member may form a first horizontal picket fastener slot, and the second fence rail brace member may form a second horizontal picket fastener slot.

12 Claims, 5 Drawing Sheets

(56) References Cited

U.S. PATENT DOCUMENTS

| | | | | |
|---|---|---|---|---|
| 6,290,214 | B1 * | 9/2001 | DeSouza | E04H 17/1413 256/69 |
| 6,802,496 | B1 * | 10/2004 | Preta | E04H 17/1447 256/65.04 |
| 8,220,781 | B2 * | 7/2012 | Gray | E04H 17/1417 256/65.13 |
| 10,030,408 | B2 * | 7/2018 | Crandall | E04H 17/1413 |

* cited by examiner

FENCE BRACE SYSTEM

CROSS-REFERENCES TO RELATED APPLICATIONS

This non-provisional utility application is a continuation of application Ser. No. 16/517,581, filed on Jul. 20, 2019, which is a continuation-in-part of application Ser. No. 14/863,793, filed on Sep. 24, 2015, now U.S. Pat. No. 10,030,408 which are hereby incorporated in their entirety by reference. This non-provisional application is a continuation-in-part of application Ser. No. 16/004,248, filed Jun. 8, 2018, which is a continuation-in-part of application Ser. No. 14/863,793, filed on Sep. 24, 2015, now U.S. Pat. No. 10,030,408, which are hereby incorporated in their entirety by reference.

BRIEF DESCRIPTION OF THE INVENTION

The present invention relates to the field of fences. More particularly, the present invention relates to a system for providing structural support for fences.

The present invention provides strength for building a new fence or repairing an existing fence. The fence would not need to be removed or modified to install the herein disclosed brace. Installation would be simple. The brace could be mass produced at low cost. The color and style of the brace could be easily adapted to match aesthetically with the fence and the surrounding area. The brace itself may be painted, stained, powder coated, colored, or made with a colored metal. The brace may also be built into a new fence. The present invention optionally includes embodiments adapted for fences with rectanguloid rails or for rectanguloid fence posts. The brace may be made of strong weather-resistant material such as steel, stainless steel, galvanized steel, aluminum, plastic, graphite, wood, or any composite material(s).

BACKGROUND OF THE INVENTION

Fence and fence structure are subject to damage due to high winds, torrential rains, heavy snowfall, vehicular accidents, termites, vandalism, earthquakes and falling trees and branches. The most common of these causes is high winds. Wind damages fences all around the world every year. Fences made of wood are especially susceptible to wind damage because wood is weakened by prolonged exposure to rain, snow, wind, and other elements. Despite the potential for damage, wood is still by far the most common residential fencing material in the United States. In 2007 alone, Americans put up 59,000 miles of wood fencing, enough to circle the globe twice. Wood is inexpensive and lightweight, and a wood fence can easily be shaped to give properties character and individuality. There are many styles, including linear post-and-rail and crisscrossing lattice, as well as myriad picket patterns and post-cap designs. And the wood may be painted or stained to match almost any landscape.

Fences could be built much stronger using heavy materials such as steel and sturdy construction. However, this might drive the costs of the fence up above what is acceptable. As well, there are the aesthetic considerations discussed above. Also, it is unlikely that a property owner would replace an existing fence merely because of the possibility that it could be damaged by the elements.

There is an unmet need, therefore, for an inexpensive way to provide a fence with additional structural support. The need is especially great with respect to existing fences and with respect to wooden fences.

BRIEF DESCRIPTION OF THE DRAWINGS

Features and advantages of certain embodiments of the present disclosure will become apparent from the following description of embodiments thereof, by way of example only, with reference to the accompanying drawings, in which.

Figure 1:
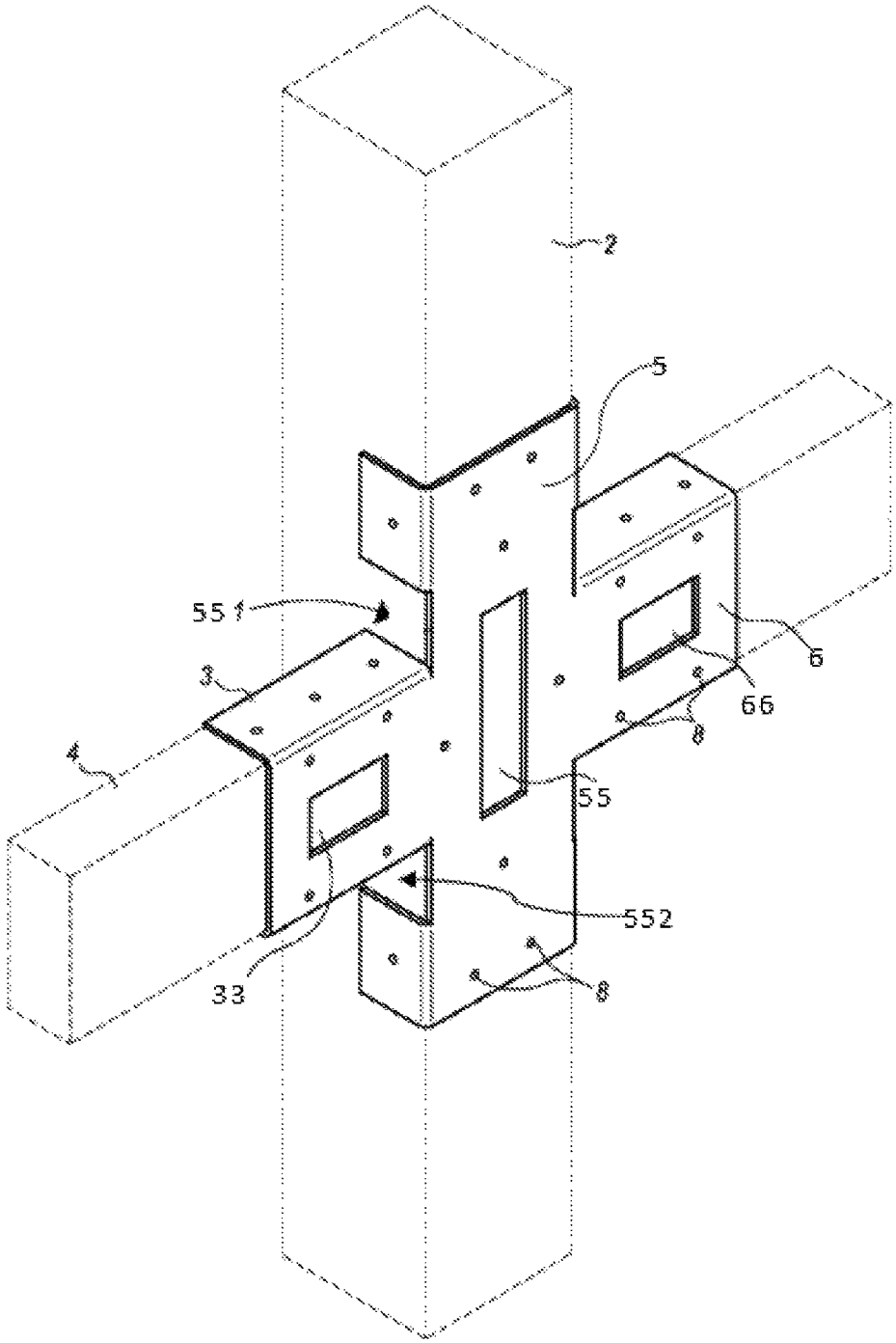
FIG. 1 illustrates an isometric view of an embodiment of a fence brace, wherein one or more flange side cutouts are formed by the fence brace, in accordance with the present invention.

The following detailed description of certain embodiments of the present disclosure will be better understood when read in conjunction with the appended drawings. For the purpose of illustrating the disclosure, certain embodiments are shown in the drawings. It should be understood, however, that the present disclosure is not limited to the arrangements and instrumentality shown in the attached drawings.

DETAILED DESCRIPTION

Figure 2:
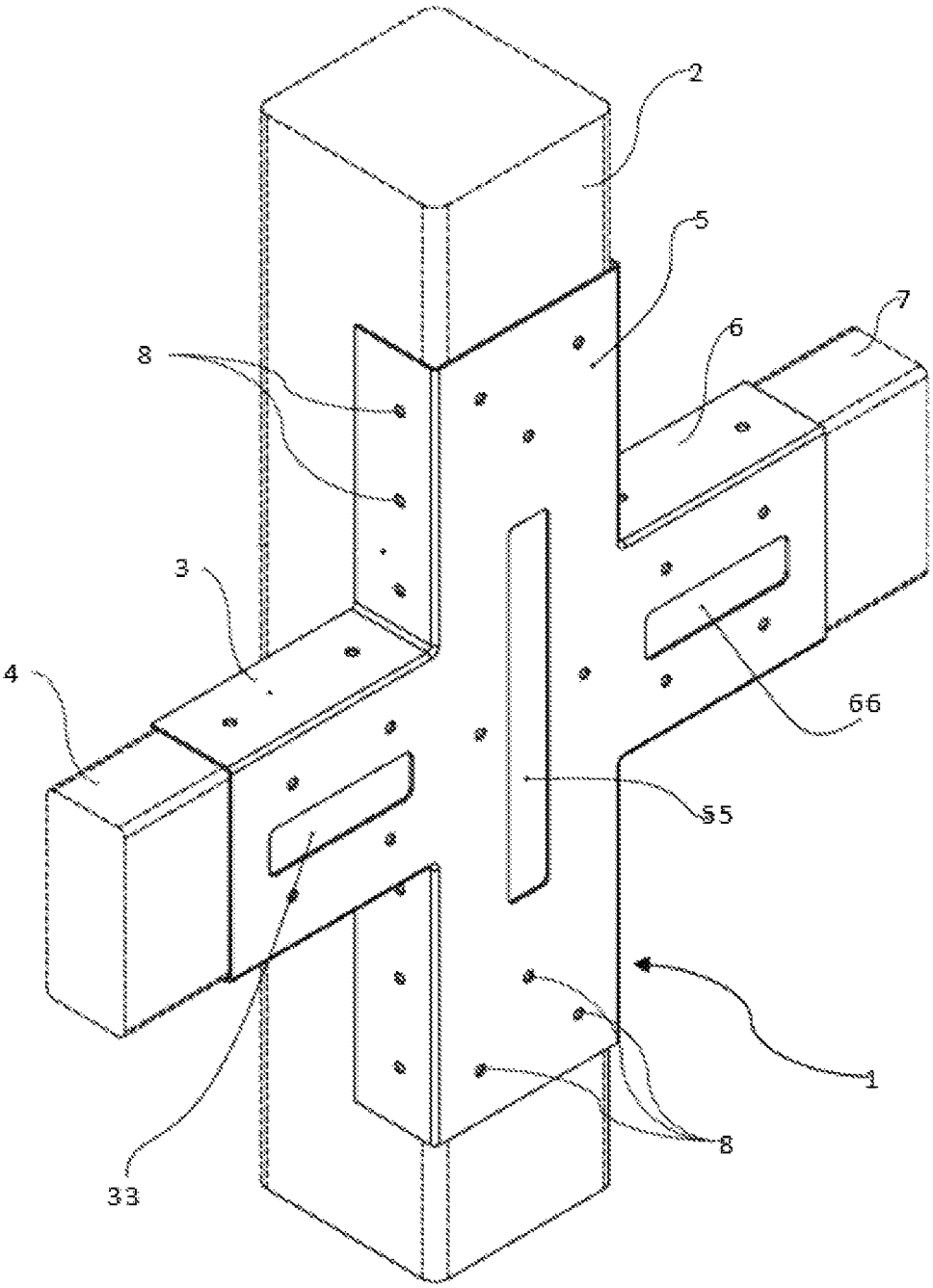
FIG. 2 illustrates an isometric view of an embodiment of a fence brace, with continuous flange sides, in accordance with the present invention.

In an embodiment as illustrated in FIG. 2, the present invention comprises fence brace 1 for securing at least one fence rail 4 to fence post 2 including first fence rail brace member 3 adapted to connect to two or more sides of first fence rail 4. First fence rail brace member 3 may be fused, e.g. welded, bonded or otherwise connected, to a first side of fence post brace member 5 wherein fence post brace member 5 is adapted to connect to two or more sides of fence post 2. The fence rail may be rectanguloid. As used herein, the term "rectanguloid" means a solid (three-dimensional) object which has six faces that are rectangles. It has the same cross-section along a length. As used herein, "rectanguloid" is the same as a rectangular prism. A rectanguloid may be thought of as a three-dimensional version of a rectangle or a square. The herein disclosed fence brace system may further include second fence rail brace member 6 fused to a second side of fence post brace member 5, wherein second fence rail brace member 6 is adapted to connect to two or more sides of second fence rail 7.

Fence brace 1 may include plurality of holes 8 thereby allowing fence post brace member 5 to be securely fastened to fence post 2 and thereby allowing first fence rail brace member 3 to be securely fastened to first fence rail 4 and second fence rail brace member 6 to be securely fastened to second fence rail 7. The plurality of holes may be referred to as fastener holes or, e.g., screw holes, nail holes, or bolt holes. The plurality of holes may each receive a screw, a nail, a bolt, or an alternative type of fastener for securely connecting fence brace 1 to the fence post and/or the fence rail(s). The various figures illustrate the plurality of holes positioned in exemplary locations; those skilled in the art will recognize that the plurality of holes may be formed in various locations on the fence brace to provide the intended benefit of allowing secure attachment of the fence brace to the fence (the fence post and the fence rails).

Fence brace 1 may be formed of a strong weather-resistant material such as selected from the group consisting of steel, stainless steel, galvanized steel, aluminum, plastic, graphite, wood, or any composite material(s).

An embodiment of the present invention may further include one or more picket fastener slots, or apertures, for allowing one or more pickets (or boards) to be attached to the fence. For example, and as illustrated in FIG. 2 as a preferred embodiment, fence post brace member 5 forms vertical picket fastener slot 55, first fence rail brace member 3 forms first horizontal picket fastener slot 33, and second fence rail brace member 6 forms second horizontal picket fastener slot 66. This embodiment allows for attachment of a picket to fence post 2 through vertical picket fastener slot 55, attachment of a picket to first fence rail 4 through first horizontal picket fastener slot 33, and/or attachment of a picket to second fence rail 7 through second horizontal picket fastener slot 66. After fastening one or more pickets through the respective picket fastener slot, the herein disclosed fence brace is positioned in between the fence and the picket.

Figure 3:
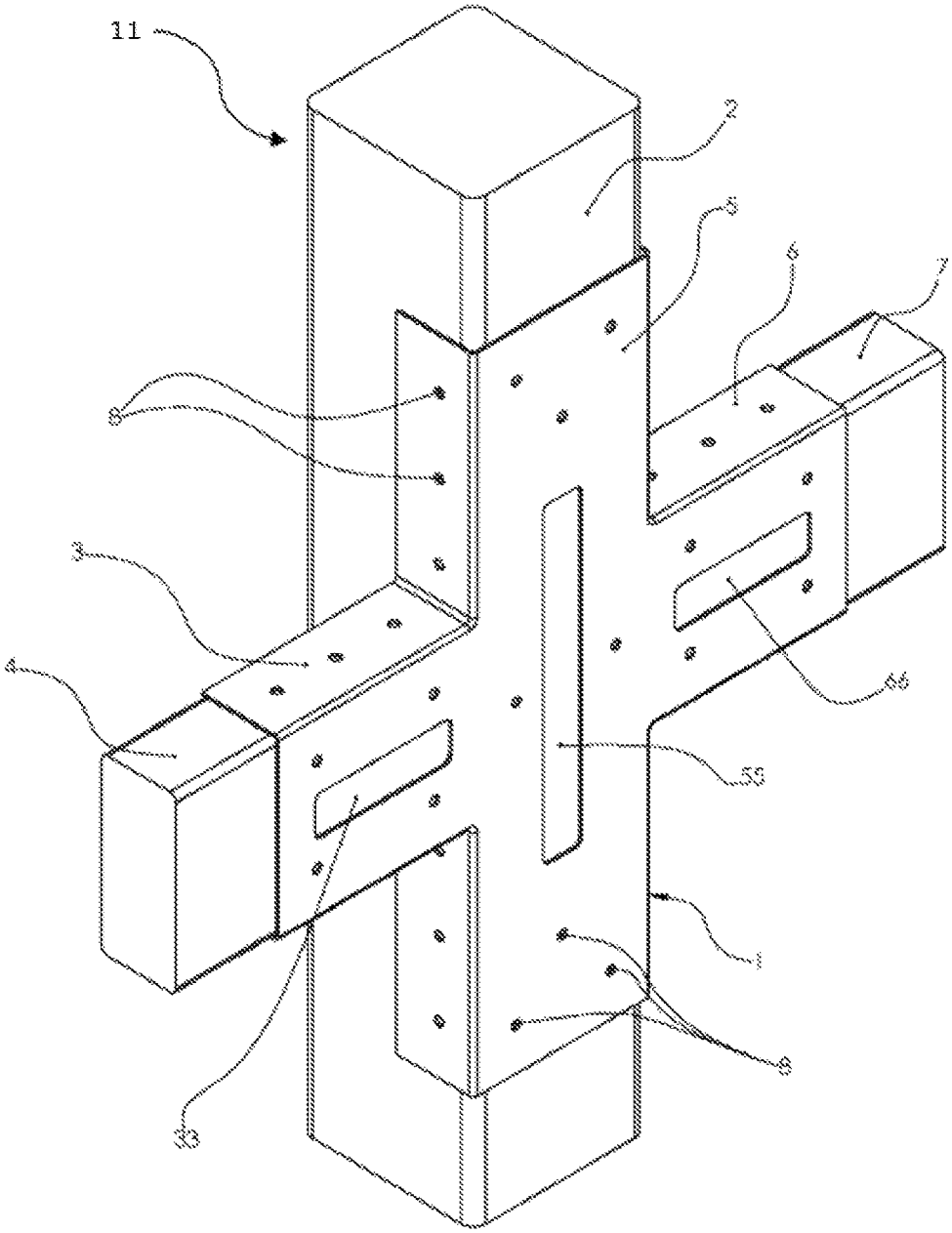
FIG. 3 illustrates an isometric view of a preferred embodiment of a fence assembly including a fence brace, a fence post, and a plurality of linearly disposed fence rails in accordance with the present invention.

Referring to FIG. 3, an embodiment of a fence brace assembly is illustrated comprising fence brace 1 attached to fence 11. Fence brace 1 includes fence post brace member 5 attached to fence post 2 and forming vertical picket fastener slot 55, first fence rail brace member 3 attached to first fence rail 4 and forming first horizontal picket fastener slot 33, and second fence brace member 6 attached to second fence rail 7 and forming second horizontal picket fastener slot 66.

Throughout this specification the fence brace system is described as including a fence post brace member, a first fence rail brace member, and a second fence rail brace member. But for the present invention, fence post brace member 5 may alternatively be referred to as a pair of opposing upper and lower fence post flanges, each of the fence post flanges comprising a planer central wall and a pair of rearward-protruding side walls extending along opposing vertical longitudinally-extending edges of the central wall, the sidewalls of the upper fence post flange being vertically-aligned with the sidewalls of the lower fence post flange to define a pair of aligned channels for receiving the fence post therein. First fence rail brace member 3 and second fence rail brace member 6 may alternatively be referred to as a pair of opposing left and right fence rail flanges, each of the fence rail flanges comprising a planar central wall and a pair of rearward-protruding side walls extending along opposing horizontal longitudinally-extending edges of the central wall, the sidewalls of the left fence rail flange being horizontally-aligned with the sidewalls of the right fence rail flange to define a pair of aligned channels for receiving the fence rails therein.

Referring to FIG. 1, an embodiment of the herein disclosed fence brace system is illustrated wherein the rearward-protruding side walls of the opposing upper and lower fence post flanges do not extend all the way to the first and second fence rails. In this embodiment illustrated in FIG. 1, an upper flange cutout 551 is formed on each side of the upper flange and a lower flange cutout 552 is formed on each side of the lower flange. The embodiment illustrated in FIG. 2 differs in that the pair of rearward-protruding side walls extend fully towards first fence rail brace member and the second fence rail brace member so that the entire edge of the fence post (or a larger portion of the edge of the fence post) is covered by the rearward-protruding side walls.

Figure 4:
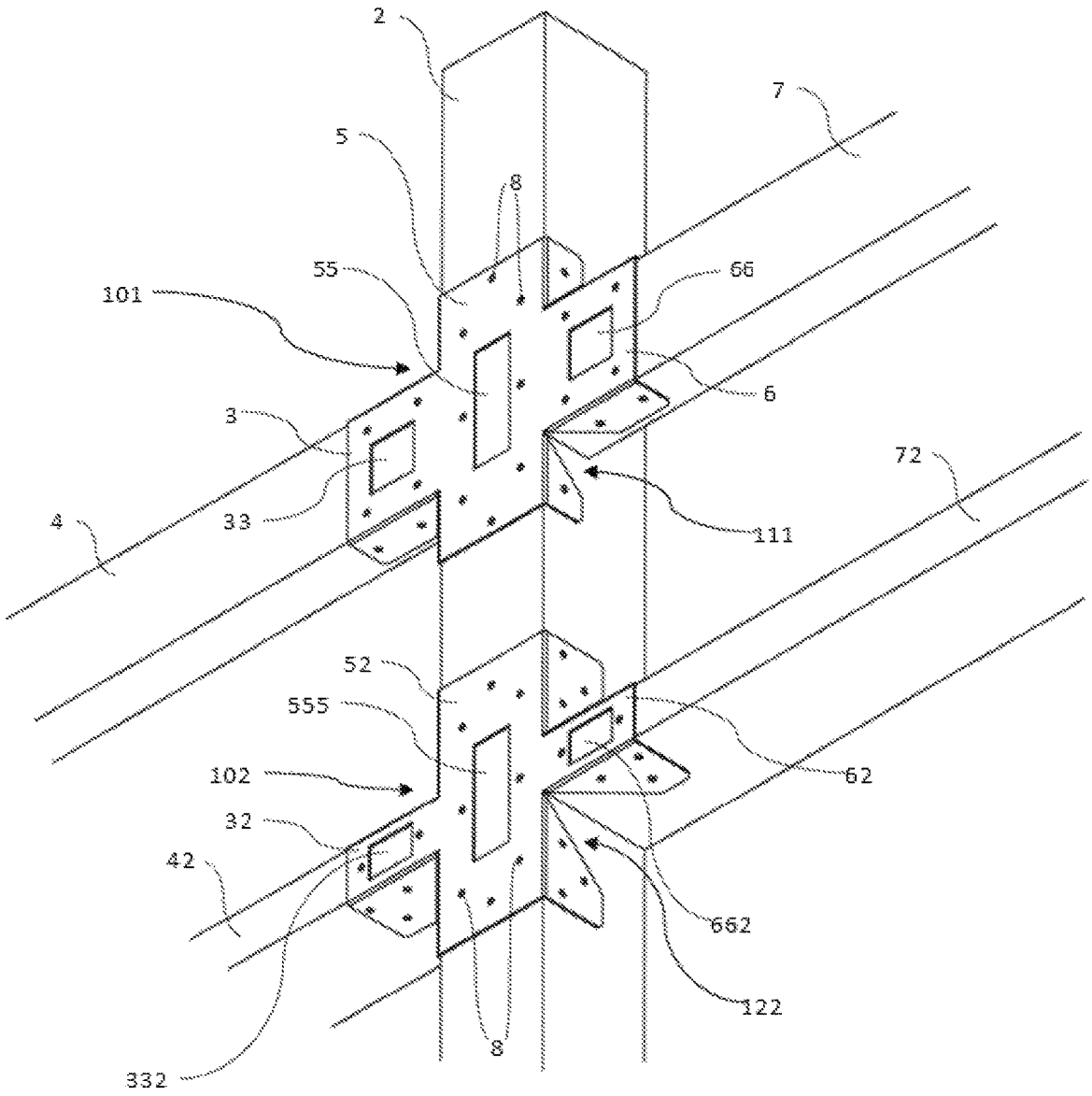
FIG. 4 illustrates an isometric view of two embodiments of a fence assembly including a fence brace, a fence post, and a plurality of linearly disposed fence rails in accordance with the present invention, wherein the fence brace includes one or more angled or slanted flange side cutouts formed by the rearward-protruding sidewalls.
Figure 5:
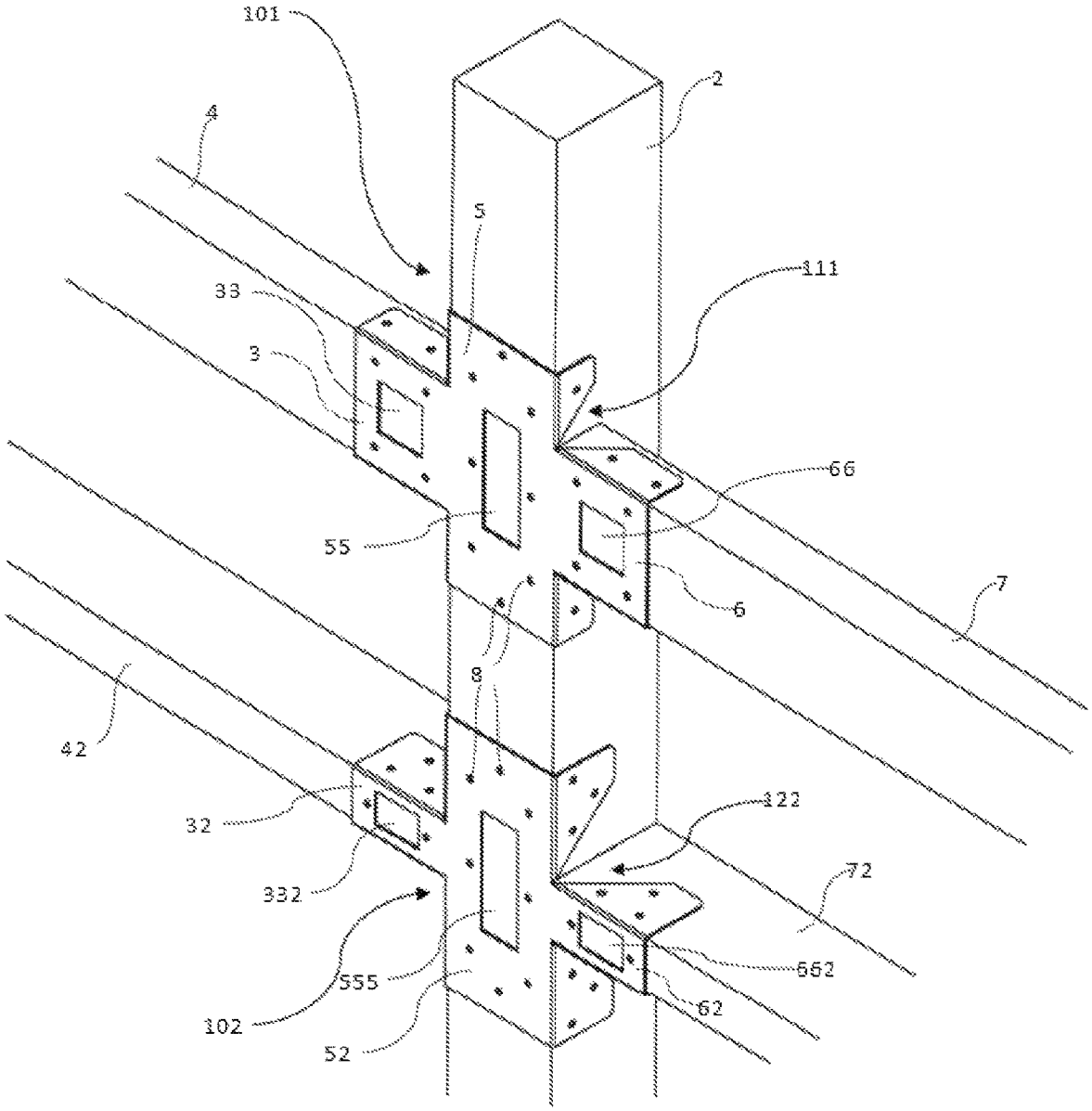
FIG. 5 illustrates an isometric view, from an alternative viewing angle, of two embodiments of a fence assembly including a fence brace, a fence post, and a plurality of linearly disposed fence rails in accordance with the present invention, wherein the fence brace includes one or more angled or slanted flange side cutouts formed by the rearward-protruding sidewalls.

Referring to FIG. 4 and FIG. 5, additional embodiments of the herein disclosed fence brace system are shown having one or more angled or slanted flange side cutouts formed by the rearward-protruding sidewalls. In these embodiments, one or more v-shaped cutouts may be formed by the rearward-protruding sidewalls.

Fence brace member 101 is adapted for use with first vertically oriented fence rail 4 and second vertically oriented fence rail 7. Fence rail 4 and fence rail 7 are referred to as vertically oriented because the respective fence rails are positioned so that they are taller than they are wide. Fence brace member 101 may be comprised of fence post brace member 5, which may be comprised of a pair of opposing upper and lower fence post flanges, each of the fence post flanges comprising a planer central wall and a pair of rearward-protruding side walls extending along opposing vertical longitudinally-extending edges of the central wall, the sidewalls of the upper fence post flange being vertically-aligned with the sidewalls of the lower fence post flange to define a pair of aligned channels for receiving the fence post therein. Fence brace member 101 may be further comprised of first fence rail brace member 3 forming first horizontal picket fastener slot 33, second fence rail brace member 6 forming second horizontal picket fastener slot 66, fence post brace member 5 forming vertical picket fastener slot 55, one or more fastener holes 8, and one or more v-shaped cutout 111. V-shaped cutout 111 may be formed at one or more corners of fence brace member 101; in an embodiment, v-shaped cutout 111 is formed at each of the four corners of fence brace member 101.

Fence brace member 102 may be comprised of fence post brace member 5, which may be comprised of a pair of opposing upper and lower fence post flanges, each of the fence post flanges comprising a planer central wall and a pair of rearward-protruding side walls extending along opposing vertical longitudinally-extending edges of the central wall, the sidewalls of the upper fence post flange being vertically-aligned with the sidewalls of the lower fence post flange to define a pair of aligned channels for receiving the fence post therein. Fence brace member 102 is adapted for use with first horizontally oriented fence rail 42 and second horizontally oriented fence rail 72. Fence rail 42 and fence rail 72 are referred to as horizontally oriented because the respective fence rails are positioned so that they are wider than they are tall. Fence brace member 102 may include first fence rail brace member 32 forming first horizontal picket fastener slot 332, second fence rail brace member 62 forming second horizontal picket fastener slot 662, fence post brace member 52 forming vertical pocket fastener slot 555, one or more fastener holes 8, and one or more v-shaped cutout 122. V-shaped cutout 122 may be formed at one or more corners of fence brace member 102; in an embodiment, v-shaped cutout 122 is formed at each of the four corners of fence brace member 102.

While the present invention has been illustrated and described herein in terms of several embodiments, it is to be understood that the devices, systems, and assemblies described herein can have a multitude of additional uses and applications. Accordingly, the invention should not be limited to just the particular description and various drawing figures contained in this specification that merely illustrate exemplary embodiments and applications of the principles of the invention.

The invention claimed is:

1. A fence assembly comprising:

a fence post having a rectangular cross-section;

first and second fence rails, each having a rectangular cross-section; and a fence brace comprising:

a pair of opposing upper and lower fence post flanges, each of the fence post flanges comprising a planer central wall and a pair of rearward-protruding side walls extending along opposing vertical longitudinally-extending edges of the central wall, the side walls of the upper fence post flange being vertically-aligned with the side walls of the lower fence post flange to define a pair of aligned channels for receiving the fence post therein, and a plurality of fastener holes disposed within the central wall and side walls of each fence post flange for receiving fasteners to secure the fence post therewith, wherein the pair of rearward-protruding side walls of the upper fence post flange protrude from and extend along the planar central wall of the upper fence post flange;

a pair of opposing left and right fence rail flanges, each of the fence rail flanges comprising a planar central wall and a pair of rearward-protruding side walls extending along opposing horizontal longitudinally-extending edges of the central wall, the side walls of the left fence rail flange being horizontally-aligned with the side walls of the right fence rail flange to define a pair of aligned channels for receiving the fence rails therein, and a plurality of fastener holes disposed within the central wall and side walls of each fence rail flange for receiving fasteners to secure the fence rails therewith;

a planar central portion of the fence brace disposed between and formed with the central walls of the upper and lower fence post flanges and the central walls of the left and right fence rail flanges, the planar central portion, the central walls of the upper and lower fence post flanges and the central walls of the left and right fence rail flanges being formed from a single planar piece of material;

a vertical picket fastener slot longitudinally-extending through the planar central portion of the fence brace and into the central wall of the upper fence post flange and central wall of the lower fence post flange for receiving a fastener therethrough to affix a picket to the fence post with the fence brace therebetween; and a pair of horizontal picket fastener slots, each longitudinally extending through the central wall of a respective one of the left and right fence rail flanges, orthogonal to the vertical picket fastener slot, for receiving fasteners therethrough to affix a picket to each fence rail with the fence brace therebetween.

2. The fence assembly as recited in claim 1, wherein the fence brace is made of a material selected from a group consisting of steel, stainless steel, galvanized steel, aluminum, plastic, graphite, and composite material.

3. The fence assembly as recited in claim 1, further comprising at least one picket, wherein the picket is fastened to the fence post by passing a fastener through the picket and through the vertical picket fastener slot and into the fence post.

4. The fence assembly as recited in claim 1, further comprising at least one picket, wherein the picket is fastened to a fence rail by passing a fastener through the picket and through one of the horizontal picket fastener slots and into the fence rail.

5. The fence assembly of claim 1, wherein one or more of the rearward-protruding side walls further comprise one or more angled or slanted flange side cutouts.

6. The fence assembly of claim 5, wherein the one or more angled or slanted flange side cutouts form one or more v-shaped cutouts.

7. A fence assembly comprising:

a fence post;

first and second fence rails; and a fence brace comprising:

a pair of opposing upper and lower fence post flanges, each of the fence post flanges comprising a planer central wall and a pair of rearward-protruding side walls extending along opposing vertical longitudinally-extending edges of the central wall, the side walls of the upper fence post flange being vertically-aligned with the side walls of the lower fence post flange to define a pair of aligned channels for receiving the fence post therein, and a plurality of fastener holes disposed within the central wall and side walls of each fence post flange for receiving fasteners to secure the fence post therewith, wherein the pair of rearward-protruding side walls of the upper fence post flange protrude from and extend along the entire planar central wall of the upper fence post flange;

a pair of opposing left and right fence rail flanges, each of the fence rail flanges comprising a planar central wall and a pair of rearward-protruding side walls extending along opposing horizontal longitudinally extending edges of the central wall, the side walls of the left fence rail flange being horizontally-aligned with the side walls of the right fence rail flange to define a pair of aligned channels for receiving the fence rails therein, and a plurality of fastener holes disposed within the central wall and side walls of each fence rail flange for receiving fasteners to secure the fence rails therewith;

a planar central portion of the fence brace disposed between and formed with the central walls of the upper and lower fence post flanges and the central walls of the left and right fence rail flanges, the planar central portion, the central walls of the upper and lower fence post flanges and the central walls of the left and right fence rail flanges being formed from a single planar piece of material;

a vertical picket fastener slot formed by the planer central portion of the fence brace for receiving a fastener therethrough to affix a picket to the fence post with the fence brace therebetween, wherein the vertical picket fastener slot extends into the central wall of the upper fence post flange and central wall of the lower fence post flange;

a first horizontal picket fastener slot, formed by the left rail flange and orthogonal to the vertical picket fastener slot, for receiving fasteners therethrough to affix a picket to the first fence rail with the fence brace therebetween; and a second horizontal picket fastener slot, formed by the right rail flange and orthogonal to the vertical picket fastener slot, for receiving fasteners therethrough to affix a picket to the second fence rail with the fence brace therebetween.

8. The fence assembly as recited in claim 7, wherein the fence brace is made of a material selected from a group consisting of steel, stainless steel, galvanized steel, aluminum, plastic, graphite, and composite material.

9. The fence assembly as recited in claim 7, further comprising at least one picket, wherein the picket is fastened to the fence post by passing a fastener through the picket and through the vertical picket fastener slot and into the fence post.

10. The fence assembly as recited in claim 7, further comprising at least one picket, wherein the picket is fastened to one of the fence rails by passing a fastener through the picket and through one of the horizontal picket fastener slots and into the fence rail.

11. The fence assembly as recited in claim 7, wherein one or more of the rearward-protruding side walls further comprise one or more angled or slanted flange side cutouts.

12. The fence assembly of claim 11, wherein the one or more angled or slanted flange side cutouts form one or more v-shaped cutouts.

* * * * *